US011414946B2

(12) United States Patent
Atkins

(10) Patent No.: US 11,414,946 B2
(45) Date of Patent: Aug. 16, 2022

(54) SYSTEMS AND METHODS FOR REMOVING AND COLLECTING MAGNETIC DEBRIS FROM DRILLING FLUID

(71) Applicant: Schlumberger Oilfield UK PLC, West Sussex (GB)

(72) Inventor: James Edward Atkins, Aberdeen (GB)

(73) Assignee: SCHLUMBERGER TECHNOLOGY CORPORATION, Sugar land, TX (US)

( * ) Notice: Subject to any disclaimer, the term of this patent is extended or adjusted under 35 U.S.C. 154(b) by 49 days.

(21) Appl. No.: 17/044,397

(22) PCT Filed: Nov. 28, 2018

(86) PCT No.: PCT/US2018/062688

§ 371 (c)(1),
(2) Date: Oct. 1, 2020

(87) PCT Pub. No.: WO2019/240835

PCT Pub. Date: Dec. 19, 2019

(65) Prior Publication Data

US 2021/0115746 A1 Apr. 22, 2021

Related U.S. Application Data

(60) Provisional application No. 62/684,650, filed on Jun. 13, 2018.

(51) Int. Cl.
*E21B 31/06* (2006.01)
*E21B 21/00* (2006.01)

(52) U.S. Cl.
CPC ..... *E21B 31/06* (2013.01); *E21B 21/002* (2013.01)

(58) Field of Classification Search
CPC ..... E21B 31/06; E21B 21/002
See application file for complete search history.

(56) References Cited

U.S. PATENT DOCUMENTS 3,637,033 A 1/1972 Mayall
7,992,636 B2 8/2011 Telfer
(Continued)

FOREIGN PATENT DOCUMENTS

CA 2730481 A1 1/2010
RU 2485279 C2 6/2013
WO 2019068378 A1 4/2019

OTHER PUBLICATIONS

International Preliminary Report on Patentability of International Patent Application No. PCT/US2018/062688 dated Dec. 15, 2020, 5 pages.

(Continued)

*Primary Examiner* — Michael R Wills, III

(57) ABSTRACT

Systems and methods for retaining magnetic debris from drilling fluid include an exterior sleeve with an interior space receiving an interior holder. A first end of the exterior sleeve is connectible to drill string to place the interior space in fluid communication with the drill string, and a longitudinal passage between the interior holder and exterior sleeve defines a flow path for drilling fluid from the drill string. Magnetic materials along and/or around the interior holder provide a magnetic field extending into or across the longitudinal passage such that magnetic debris is removable by the magnetic field from the flow path of drilling fluid passing through the longitudinal passage.

20 Claims, 16 Drawing Sheets

(56) References Cited

U.S. PATENT DOCUMENTS

| | | | | |
|---|---|---|---|---|
| 8,678,091 | B2 | 3/2014 | Nelson et al. | |
| 2006/0011346 | A1* | 1/2006 | Theriot, Sr. | E21B 37/00 166/311 |
| 2011/0168404 | A1* | 7/2011 | Telfer | E21B 37/00 166/378 |
| 2011/0284210 | A1* | 11/2011 | Hern | E21B 31/06 166/99 |
| 2014/0096972 | A1* | 4/2014 | Leiper | E21B 37/00 166/311 |
| 2015/0122480 | A1* | 5/2015 | Sullivan | E21B 31/06 166/66.5 |
| 2017/0247980 | A1* | 8/2017 | Linklater | E21B 37/00 |

OTHER PUBLICATIONS

International Search Report and Written Opinion issued in International Patent application PCT/US2018/062688 dated Feb. 7, 2019, 7 pages.

Examination Report in GB Patent Application No. GB2018434.7, dated Feb. 10, 2022, 1 page.

* cited by examiner

FIG. 2A
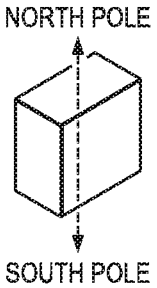
FIG. 2B
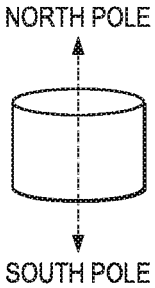
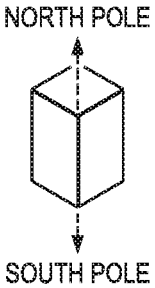
FIG. 2C
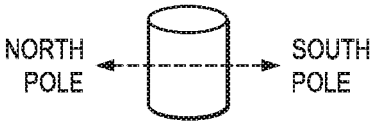
FIG. 2D
FIG. 2E
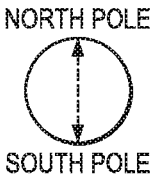
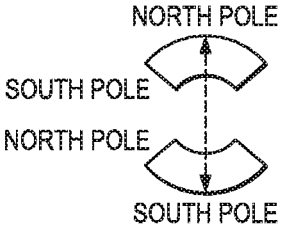
FIG. 2F
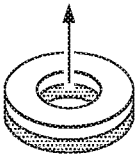
FIG. 2G
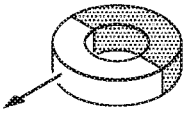
FIG. 2H
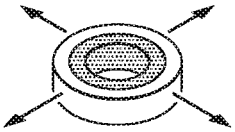
FIG. 2I
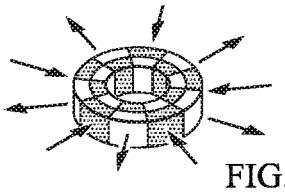
FIG. 2J
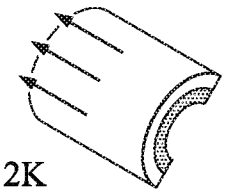
FIG. 2K
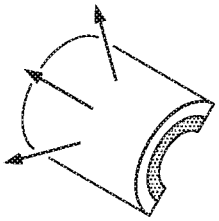
FIG. 2L
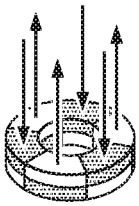
FIG. 2M
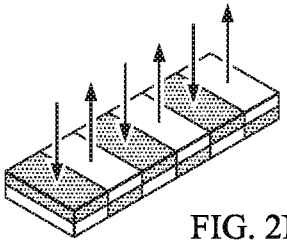
FIG. 2N

SYSTEMS AND METHODS FOR REMOVING AND COLLECTING MAGNETIC DEBRIS FROM DRILLING FLUID

This application claims the benefit of U.S. Provisional Application having Ser. No. 62/684,650 filed on Jun. 13, 2018, the entire contents of which are incorporated herein by reference in their entirety.

BACKGROUND OF THE DISCLOSURE

Traditionally, a bottom hole assembly (hereinafter "BHA") and drill bit provided at or near an end of a drill string are utilized to form a borehole in a subsurface formation during a drilling operation. More recently, the BHA has become increasingly more sophisticated with various high-performance and/or highly sensitive elements or components being provided thereon. For example, the BHA often includes one or more downhole elements and/or components (hereinafter "downhole components"), such as, for example, at least a rotary steerable system (hereinafter "RSS"), one or more formation evaluation (hereinafter "FE") measurement tools, at least one direction and inclination (hereinafter "D&I") measurement tools, one or more mud motors, at least one drill bit, one or more measuring-while-drilling (hereinafter "MWD") tools, one or more logging-while-drilling (hereinafter "LWD") tools and/or and at least one power generation system for the one or more MWD and/or LWD tools.

Magnetic, metallic, ferrous and/or ferromagnetic debris (hereinafter "magnetic debris") is often found or is present in a fluid, such as a drilling mud or fluid (hereinafter "drilling fluid") that is pumped through the drill string to the BHA or otherwise passed through the BHA. For example, the magnetic debris, which may include metal or metallic particles, often is not completely removed, or is only partially removed, from drilling fluid before the drilling fluid is pumped into the drill string and down the borehole to the BHA. Such magnetic debris present in drilling fluid being pumped into and through the drill string to the BHA often restricts and/or damages the one or more downhole components of the BHA that are in fluid communication with drill string and/or contacting the drilling fluid having the magnetic debris therein. As a result of the restrictions and/or damage caused by the magnetic debris, the one or more downhole components of the BHA may become inoperable and/or may experience a reduction in efficiency.

The present systems and methods remove, retained and/or collect magnetic debris from drilling fluid passing through the drill string to the BHA. As a result, the present systems and methods may substantially reduce and/or prevent magnetic debris from reaching the BHA such that restriction and/or damage to the BHA and/or the one or more downhole components of the BHA may be reduce and prevented, or at least substantially reduced.

BRIEF DESCRIPTION OF THE DRAWINGS

Certain embodiments of the disclosure will hereafter be described with reference to the accompanying drawings, wherein like reference numerals denote like elements. It is emphasized that, in accordance with standard practice in the industry, various features are not drawn to scale. In fact, the dimensions of various features may be arbitrarily increased or reduced for clarity of discussion. It should be understood, however, that the accompanying figures illustrate the various implementations described herein and are not meant to limit the scope of various technologies described herein, and:

FIGS. 2A-2N are perspective and plan views of magnet shapes and/or magnetization types usable within a magnetic debris collecting tool in embodiments of the present disclosure;

FIGS. 5A-5C illustrate an assembled magnetic debris collecting tool according to embodiments of the present disclosure, wherein FIG. 5A is a perspective, partially cut away, view of the assembled magnetic debris collecting tool according to embodiments of the present disclosure, FIG. 5B is a cross-sectional view of the assembled magnetic debris collecting tool shown in FIG. 5A according to embodiments of the present disclosure, and FIG. 5C is an enlarged perspective view of a cutaway portion of the assembled magnetic debris collecting tool shown in FIG. 5A according to embodiments of the present disclosure;

FIGS. 9A-9F illustrate views of a fastener assembly and components thereof in embodiments of the present disclosure, wherein FIG. 9A illustrates a perspective view of fastener assembly components in embodiments of the present disclosure, FIG. 9B is a side cross-sectional view of a fastener assembly in embodiments of the present disclosure, FIG. 9C is a top cross-section view of the fastener assembly shown in FIG. 9B in embodiments of the present disclosure; FIG. 9D is an enlarged view of an end portion of the fastener assembly shown by the dashed lines of FIG. 9C in embodiments of the present disclosure, FIG. 9E is a bottom plan view of the fastener assembly shown in FIG. 9B in embodiments of the present disclosure, and FIG. 9F is a top plan view the fastener assembly shown in FIG. 9B in embodiments of the present disclosure;

FIGS. 11A-11D illustrates another magnetic debris collecting tool according to embodiments of the present disclosure, wherein FIG. 11A is a side cross-sectional view of another magnetic debris collecting tool in embodiments of the present disclosure, FIG. 11B is a side cross-sectional view, including fluid flow, of the magnetic debris collecting tool, shown in FIG. 11A, according to embodiments of the present disclosure, FIG. 11C is a top or bottom cross-section view of the magnetic debris collecting tool, shown in FIG. 11A, in embodiments of the present disclosure, and FIG. 11D illustrates a flux diagram of magnetic field lines and strengths associated with the magnetic debris collecting tool, shown in FIG. 11C, in embodiments of the present disclosure.

DETAILED DESCRIPTION OF THE DISCLOSURE

Figure 1:
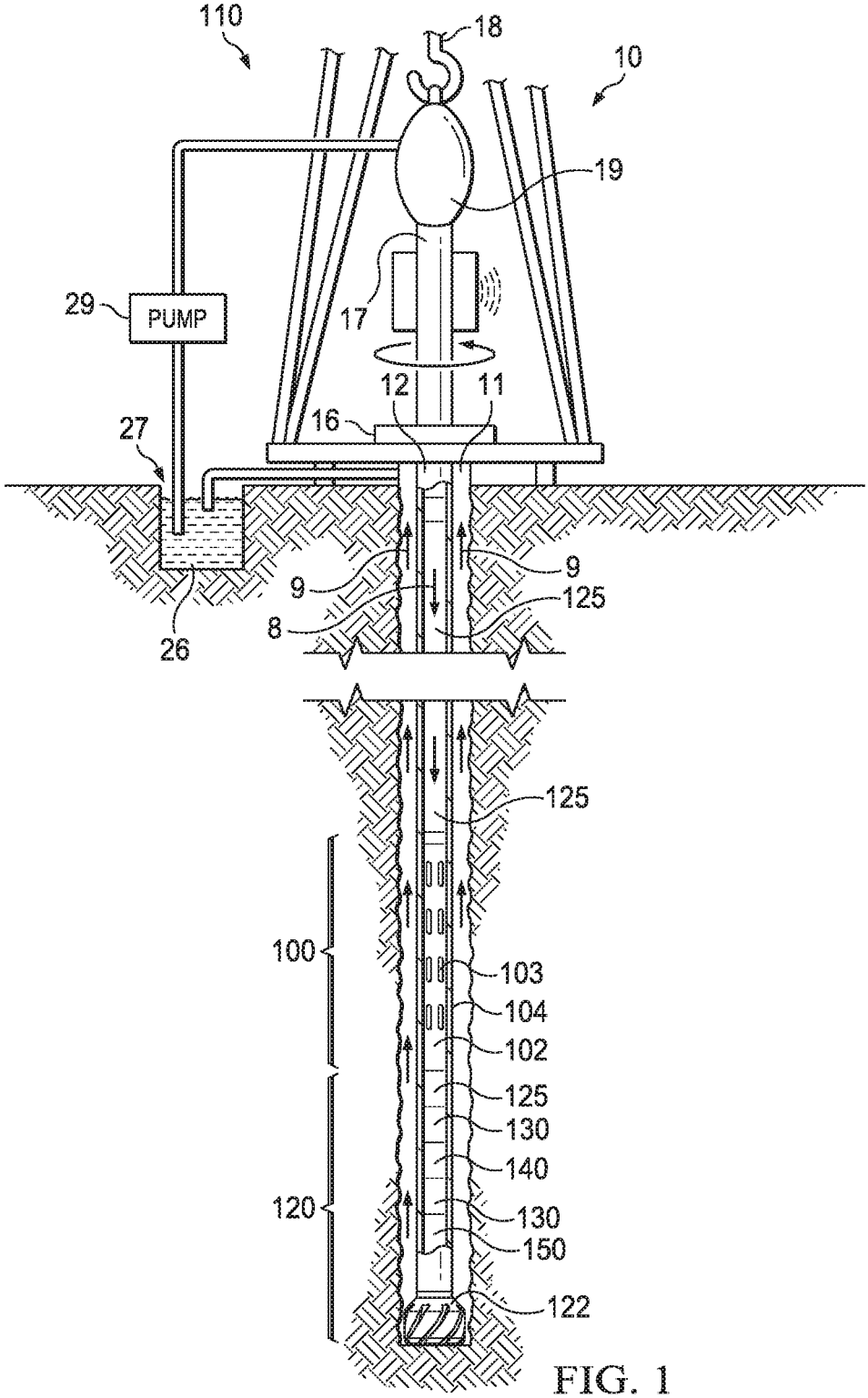
FIG. 1 is a schematic diagram of an example drilling system according to embodiments of the present disclosure.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

FIG. 1 is a schematic diagram of an exemplary drilling system 110 (hereinafter "drilling system 110") in embodiments of the present disclosure, comprising at least one magnetic debris collecting tool 100 (hereinafter "collecting tool 100"). It should be understood that the drilling system 110 may be provided at a wellsite which may be an onshore or offshore wellsite and the drilling system 110 may comprise any combination of the various elements described herein.

In at least one drilling operation, the drilling system 110 may form a borehole 11 in a subsurface formation by rotary drilling with a drill string 12 suspended within the borehole 11. The drilling system further comprises a bottom hole assembly 120 (hereinafter "BHA 120") attached or connected to the drill string 12, wherein the BHA 120 includes a drill bit 122 at a lower end of the BHA 120 that is opposite with respect to the drill string 12.

The drilling system 110 includes a platform and derrick assembly 10 (hereinafter "assembly 10") positioned over the borehole 11, wherein the assembly 10 may include a rotary table 16, a kelly 17, a hook 18 and/or a rotary swivel 19. The drill string 12 may be rotated by the rotary table 16, energized by means not shown, which engages the kelly 17 at the upper end of the drill string 12. The drill string 12 may suspended from a hook 18, attached to a traveling block (also not shown), through the kelly 17 and the rotary swivel 19 which permits rotation of the drill string 12 relative to the hook 18. Alternatively, a top drive system may be utilized instead of the kelly 17 and/or the rotary table 16 to rotate the drill string 12 from the surface above the borehole 11. The drill string 12 may be assembled from a plurality of segments 125 comprising at least pipe and/or one or more collars threadedly joined end to end.

In the embodiment of the present disclosure illustrated in FIG. 1, the drilling system 110 may further comprise drilling fluid or mud 26 (hereinafter "drilling fluid 26") stored in a pit 27 formed at the wellsite. A pump 29 may deliver the drilling fluid 26 to an interior of the drill string 12 via a port in the rotary swivel 19 which may cause the drilling fluid to flow downwardly through the drill string 12 and the BHA 120 as indicated by the directional arrow 8. The drilling fluid 26 may exit the drill string 12 via ports in the drill bit 122, and then circulates upwardly through an annulus region between an outside of the drill string 12 and a wall of the borehole 11, as indicated by directional arrows 9. In the drilling system 110 as understood by one of ordinary skill in the art, the drilling fluid 26 may lubricates the drill bit 122 and/or may carry formation cuttings up to the surface adjacent to the borehole 11 as the drilling fluid 26 may by returned to the pit 27 for cleaning and recirculation.

The BHA 120 may have or comprise at least one LWD module 130, at least one MWD module 140, at least one motor 150, and/or at least one drill bit 122. It should be understood that the at least one LWD module 130 and/or the at least one MWD 140 module may be configured and/or adapted for measuring, processing, storing, and communicating information, regarding or associated with the drill string 12, the BHA 120 and/or the borehole 11, to the surface.

In embodiments, the drilling system 110 and/or drill string 12 may comprise and/or include the collecting tool 100 which may be located at and/or positioned above the BHA 120 and/or closer to the surface of the wellsite than the BHA 120. Alternatively, the collecting tool 100 may be located at and/or positioned adjacent to the BHA 120 or at a position along the length of the drill string 12 between the BHA 120 and the surface of the wellsite. As schematically shown in FIG. 1, the collecting tool 100 may have an interior magnet holder 102 (hereinafter "holder 102") which may have magnetic material affixed or connected thereto, located or positioned within the holder 102 and/or housed or recessed within or along an exterior surface of the holder 102. In embodiments, the magnetic material may comprise one or more magnets 103 (hereinafter "magnets 103") that may be affixed or connected to the holder 102, which may be housed or recessed within the holder 102 and/or may extend along a length, a width and/or a circumference of the holder 102, or at least portions thereof. The holder 102 may be housed within and/or insertable into an exterior sleeve 104 (hereinafter "the sleeve 104") of the collecting tool 100 such that one or more passages between the holder 102 and sleeve 104 is provided for pumping the drilling fluid 26 therebetween. The holder 102 and the sleeve 104 may be coupled together and/or connectible or attachable to each other such that fluids (i.e., drilling fluid 26) may flow or pass therebetween through the collecting tool 100 from the surface of the wellsite to the BHA 120.

The magnetic debris which may be contained and/or present within the drilling fluid 26 that is pumped through the drill string 125 in the direction shown by directional arrow 8, may enter the collecting tool 100 as the drilling fluid 26 is pumped or moved through the drill string 12 from the surface of the wellsite to or towards the BHA 120 in the borehole 11. Further, the drilling fluid 26 with the magnetic debris may flow or otherwise be positioned near, adjacent to and/or in contact with the magnets 103 of the collecting tool 100. As a result, the magnetic debris contained and/or present within the drilling fluid 26 passing through the collecting tool 100 may be removed, extracted and/or collected from the drilling fluid 26 by the magnets 103, that may be affixed to and/or connected to the holder 102 and/or provided inside the sleeve 104 of the collecting tool 100. It should be understood that the present disclosure is not limited to a specific embodiment of the magnetic debris which may be any debris exhibiting magnetic properties and/or collectible by the magnets 103 and/or on one or more magnetic surfaces areas adjacent to the magnets 103 of the collecting tool 100.

The holder 102, the sleeve 104 and/or the collecting tool 100 may be configured and/or adapted to provide the one or more magnetic surface areas. The one or more magnets 103 may be positioned on or about the magnetic surface areas to remove, extract and/or collect the magnetic debris from the drilling fluid 26 passing or moving though the collecting tool 100. The magnetic debris collected on, at and/or near the one or more magnetic surface areas of the collecting tool 100 may be removed or further collected therefrom at the surface of the wellsite, in the borehole 11 by one or more downhole tools and/or components and/or while the collecting tool 100 may be pulled or removed from the borehole 11.

With the magnetic debris extracted onto and/or collected on, at and/or near the one or more magnetic surface areas, the collecting tool 100 and/or the one or more magnets 103 may restrict, reduce and/or prevent the magnetic debris or at least a portion of the magnetic debris from reaching, contacting, restricting and/or damaging the BHA 120 or other sensitive components associated with or connected to the BHA 120, such as, for example, the at least one LWD 130 module, the at least one MWD 140 module and/or the at least one motor 150. As a result of restricting, reducing and/or preventing the magnetic debris or at least the portion of the magnetic debris from reaching or contacting the BHA 120, the collecting tool 100 and/or the magnets 103 may retain the magnetic debris until the collecting tool 100 is pulled from the borehole 11 and/or may protect the BHA 120, at least one LWD module 130, at least one MWD module 140, at least one motor 150, and/or at least one drill bit 122 from the magnetic debris. In an embodiment, the collecting tool 100 may minimize pressure loss across the drilling system 110 by collecting and retaining the magnetic debris, or at least a portion thereof, on, at and/or near the one or more magnetic surface areas of the collecting tool 100. Still further, the collecting tool 100 may reduce or prevent the magnetic debris from interfering with any directional survey tools (not shown in the drawings) incorporated into the drill string 12 and/or the BHA 120.

In embodiments, the drilling system 110 is configured or adapted for removing, collecting and/or retaining magnetic debris from the drilling fluid 26 in the wellbore 11. The collecting tool 100 may comprise the holder 102 having a total length defined between a first end of the holder 102 and an opposite second end of the holder 102. The collecting tool 100 may also comprise the sleeve 104 having a length defined between a first end of the sleeve 104 and an opposite second end of the sleeve 104 and an interior space configured to receive the holder 102, wherein the first end of the sleeve 104 is connectible to a first portion of the drill string 12 and/or the BHA 120 such that, when the sleeve 104 is connected to the drill string 12, the interior space of the sleeve 104 may be in fluid communication with a longitudinal bore of the drill string 12. Further, the collecting tool 100 may comprise at least one longitudinal passage provided between the holder 102 and the sleeve 104 and extending from the first end of the sleeve 104 to the second end of the sleeve 104 while the holder 102 is located within the sleeve 104 such that a fluid flow path of the drilling fluid 26 through the longitudinal bore of the drill string 12 is passable from the first portion of the drill string 12 through the at least one longitudinal passage when the sleeve 104 is connected to the first portion of drill string 12. Still further, the collecting tool 100 may comprise a plurality of magnetic material, such as, the one or more magnets 103 provided on or in the holder 102, wherein the plurality of magnetic material extends at least one selected from along at least a portion of the length of the holder 102 and around at least a portion of a circumference of the holder 102, wherein at least one magnetic field, provided by the plurality of magnetic material, extends into or across the at least one longitudinal passage while the holder 102 is located within the sleeve 104 such that magnetic debris is removable by the at one magnetic field from the fluid flow path of the drilling fluid 26 passing through the at least one longitudinal passage when the sleeve 104 is connected to the first portion of the drill string 12.

In embodiments, the present systems and methods may provide the sleeve 104 having a length defined between a first end of the sleeve 104 and an opposite second end of the sleeve 104 and an interior space defined by a wall of the sleeve 104 extending between the first and second ends of the sleeve 104, wherein the first end of the sleeve 104 is connectible to a first portion of the drill string 12. Additionally, the one or more magnets 103 may be positioned on or adjacent to an exterior surface of the holder 102 that has a length defined between a first end of the holder 102 and an opposite second end of the holder 102. Further, the holder 102 may be positioned in the interior space of the sleeve 104 such that at least one fluid flow path is provided between the exterior surface of the holder 102 and the sleeve 104 or extends from the first end of the sleeve 104 to the second end of the sleeve 104 and at least one magnetic field of the one or more magnets 103 extends into or across the fluid flow path for retaining magnetic debris from the drilling fluid 26 passing or moving along the at least one fluid flow path.

In embodiments, the collecting tool 100 may comprise the sleeve 104 having a length defined between a first end of the sleeve 104 and an opposite second end of the sleeve 104, wherein the first end of the sleeve 104 is connectible to at least one portion of the drill string 12. Further, the collecting tool 100 may comprise at least one fluid flow path extending through the sleeve 104 from the first end of the sleeve 104 to the second end of the sleeve 104 such that the at least one fluid flow path is in fluid communication with the first portion of the drill string 12 when the sleeve 104 is connected to the at least one portion of the drill string 12. Still further, the collecting tool 100 may comprise one or more magnetic surface areas provided inside the sleeve 104 and adjacent with respect to at least one portion of the at least one fluid flow path extending though the sleeve 104 such that magnetic debris in the drilling fluid 26 flowing or passing along the at least one fluid flow path is collectible at or on the one or more magnetic surface areas when the sleeve 104 is connected to the at least one portion of the drill string 12. Yet still further, the collecting tool 100 may comprise the holder 102 having a hollow core 212 (shown in FIG. 3) positioned insider the sleeve 104, wherein the at least one portion of the at least one fluid flow path contacts an exterior surface of at least one portion of the holder 102 comprising the one or more magnetic surface areas.

Figure 3:
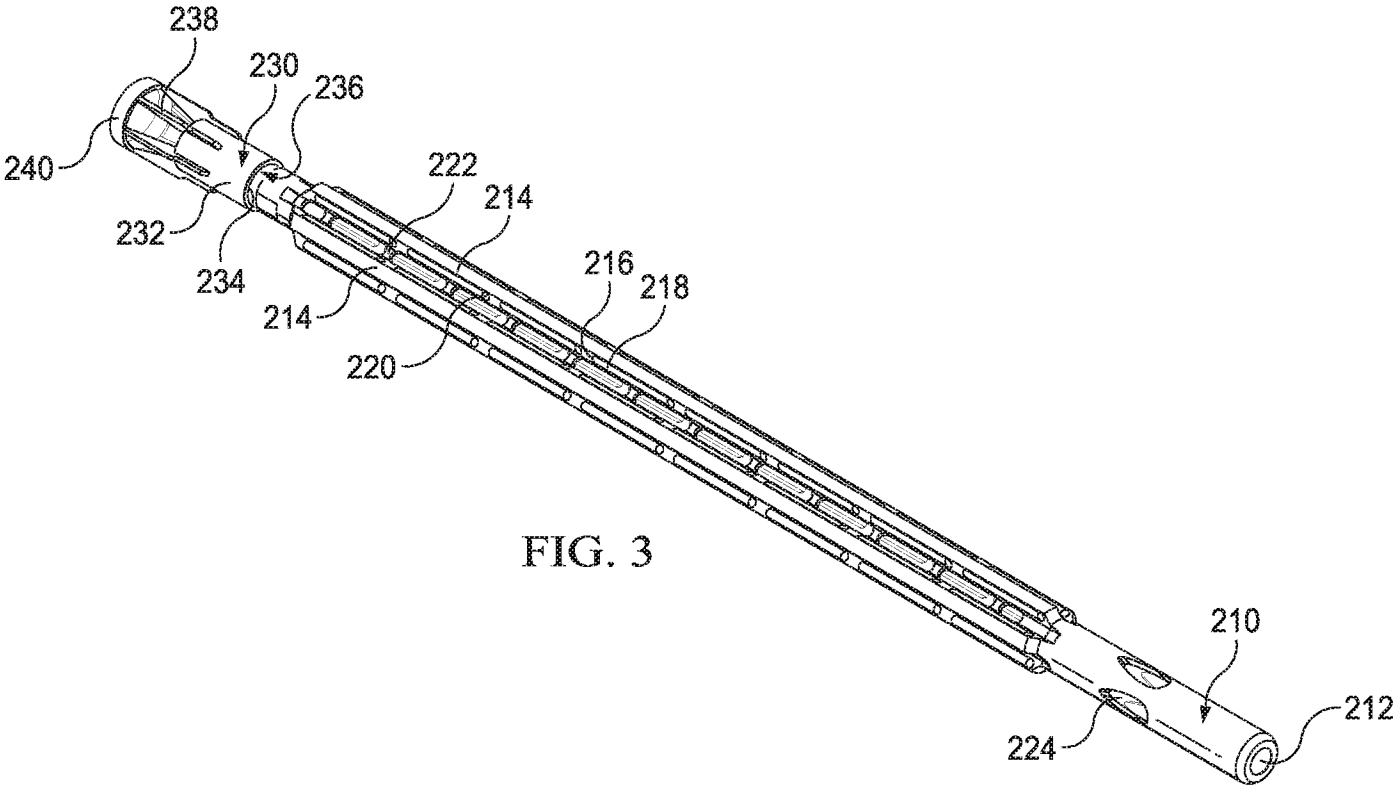
FIG. 3 is a perspective view of a first part of a magnetic debris collecting tool according to embodiments of the present disclosure.
Figure 4:
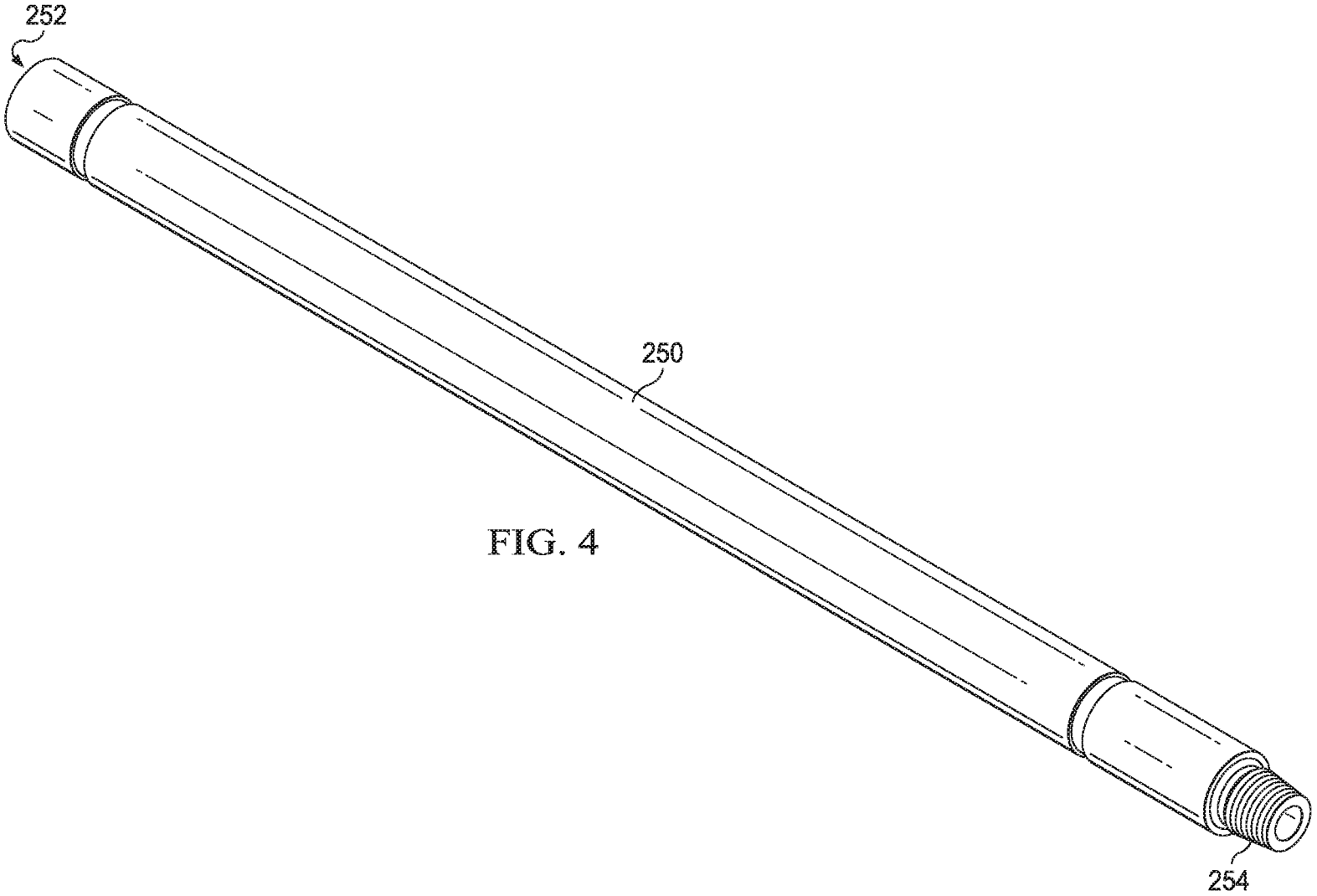
FIG. 4 is a perspective view of a second part of the magnetic debris collecting tool, shown in FIG. 3, according to embodiments of the present disclosure.
Figure 5A:
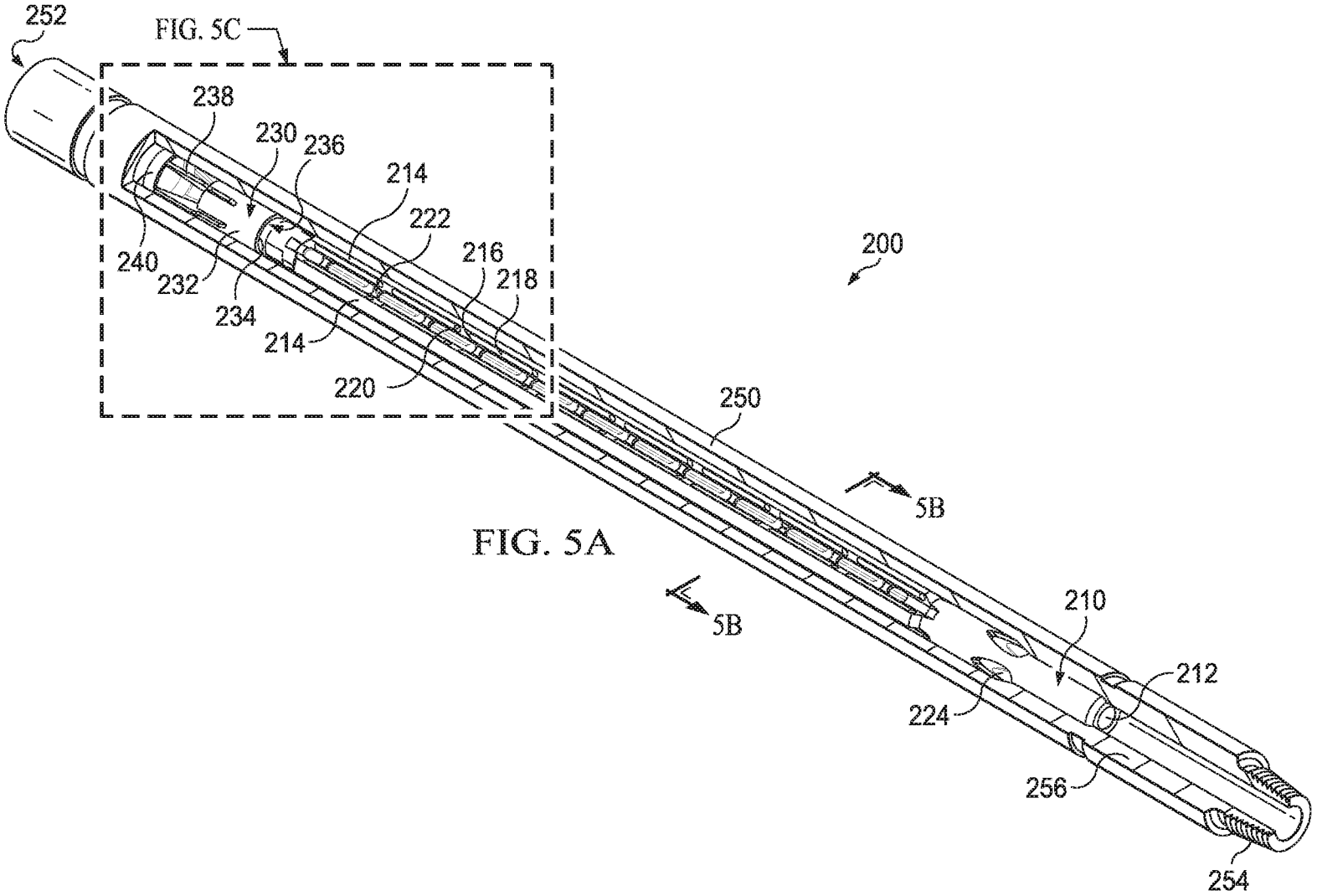

FIGS. 3, 4 and 5A-5C illustrate a magnetic debris collecting tool 200 (hereinafter "collecting tool 200") which is at least similar to, or may be the same as, the collecting tool 100 shown in FIG. 1. Additionally, the collecting tool 200 may be incorporated into the drill string 12, similarly to the incorporation of the collecting tool 100 into drill string 12 in FIG. 1. Further, the collecting tool 200 may operate and/or function within drilling system 110 the same as or similar to the collecting tool 100 in FIG. 1. Similar to the collecting tool 100, the collecting tool 200 may comprise an interior magnet holder 210 (hereinafter "the holder 210") and an exterior sleeve 250 (hereinafter "the sleeve 250"). FIGS. 3 and 4 are perspective views of the holder 210 and the sleeve 250, respectively and FIG. 5A is a perspective view, with a partial cutaway portion, of the collecting tool 200 wherein the holder 210 is located, positioned and/or inserted inside the sleeve 250 to form, produce or provide the collecting tool 200.

As shown in FIG. 3, the holder 210 of the collecting tool 200 may have a hollow core 212 that may provide at least one central fluid pathway for allowing drilling fluids 26, wash fluids, and the like to flow through the interior of the collecting tool 200. The holder 210 may have one or more radially projecting longitudinal fins 214. It should be understood that while the embodiment of the disclosure described with reference to FIGS. 3, 4 and 5A-5C illustrates five (5) fins 214, any number of fins 214 may be provided depending upon the wellbore size, type, and anticipated metallic debris.

In embodiments, the fins 214 may extend the length of the holder 210 and have one or more slots 216 that may be configured for receiving, housing, storing and/or protecting one or more magnets 218 (hereinafter "the magnets 218"). It should be understood that in other embodiments, the slots 216 may comprise chambers, depressions, through holes or other configurations suitable for housing, storing and/or holding the magnets 218 along the longitudinal fins 214.

At least one recess 222 may be formed between or adjacent to each pair of fins 214. The recess 222 may provide both at least one channel for fluid flow and at least one space for the collection or retaining of the magnetic debris from drilling fluid 26. As fluid flows through the recess 222, the magnetic debris may be retained, captured and/or held by the magnets 218 that may be housed, located and/or provided in or on the fins 214 of the holder 210. The fluid, less the collected or retained magnetic debris, may be communicated, flowed, transferred and/or moved to the hollow core 212 through one or more flow receptacles 224 that may be located at the downhole end of the holder 210. The flow of fluid may also be communicated, flowed, transferred and/or moved further downhole through components such as the BHA 120, as shown FIG. 1.

Referring back to FIGS. 3, 4 and 5A-5C, a fastener assembly 220 may connect, attach, secure and/or hold the magnets 218 in or on the fins 214. In embodiments, the fastener assemblies 220 are described in more detail below with reference to FIGS. 9A-9F and 10, although other fastener assemblies 220 known in the art may be utilized in one or more embodiments of the present disclosure. In an embodiment, the slots 216 may extend through the fins 214 or at least a portion of the fins 214 such that first surfaces of the magnets 218 may be exposed or uncovered to first sides of the longitudinal fin 214 and the other sides of the magnets 218 may be exposed to the other sides of the longitudinal fin 214. In other embodiments, the slots 216 may be configured such that at least first surfaces of the magnets 218 may be exposed or uncovered.

The holder 210 of the collecting tool 200 may further comprise at least one retainer 230, that may provide support to the holder 210 inside the sleeve 250 as shown in FIG. 4. The retainer 230 may comprise a debris collecting tool end 232 having an inner surface 234 which may be configured or adapted for connection to a retainer end 236 of the holder 210. In an embodiment, the debris collecting tool end 232 of the retainer 230 and/or the retainer end 236 of the interior magnet holder 210 may have one or more mating threads for connection together. However, in other embodiments, other types of connections and/or connectors, such as welded joints, may be used to connect the retainer 230 to the holder 210. Further, in some embodiments, the retainer 230 and/or the holder 210 may be formed as a single body and/or as an integral body, piece or tool.

Figure 5B:
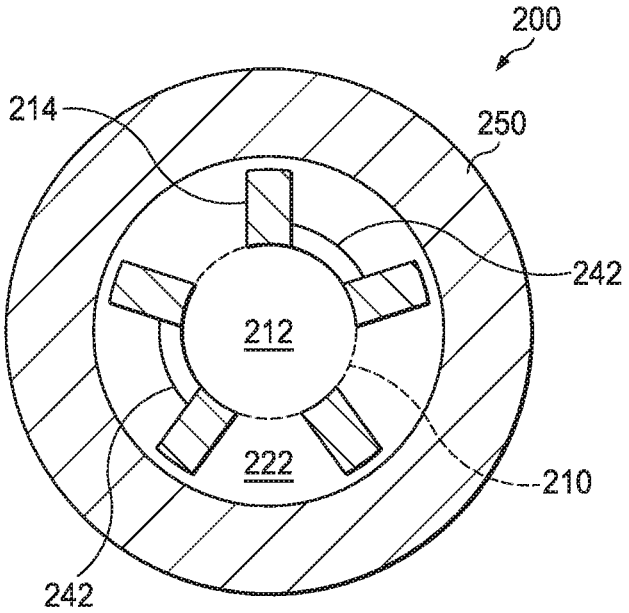
Figure 5C:
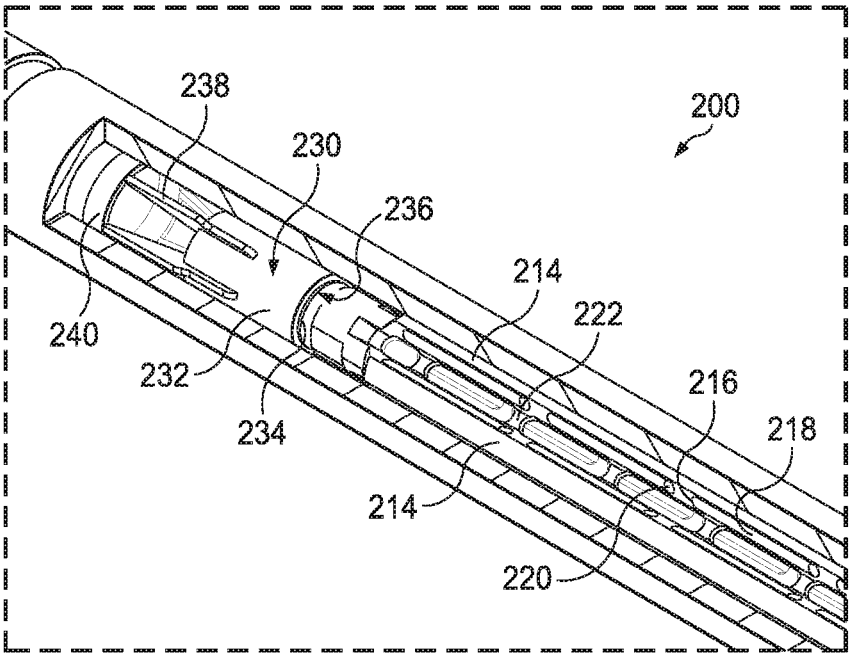

As best seen in FIG. 5C, the retainer 230 may further comprise one or more vanes 238 that may be projecting outwardly from the retainer 230 longitudinally from the collecting tool end 232 to a collar 240. The one or more vanes 238 may maintain and/or hold the holder 210 centralized within the sleeve 250.

In embodiments, the sleeve 250 may have at least one interior surface and/or an interior space that may be configured for receipt of the holder 210 therein such that the holder 210 may be housed, located and/or provided within the sleeve 250. The sleeve 250 may have at least one uphole connector end 252 and at least one downhole connector end 254. The at least one uphole connector end 252 may engage the retainer 230 of the holder 210 such that the holder 210 may remain centralized within the sleeve 250. The at least one uphole connector end 252 may be adapted for connection to the drill string 12 (as shown in FIG. 1) or other tools or components uphole of the collecting tool 200. The at least one downhole connector end 252 may be adapted for connection to downhole components such as, for example, the drill string 12 and/or the BHA 120 (as shown in FIG. 1). Although the connector ends 252, 254 may be threaded connections, it should be understood that, in other embodiments, alternate connection mechanisms for the connector ends 252, 254 may be used.

In embodiments, collecting tool 200 may be assembled by inserting, locating and/or positioning the holder 210 inside the sleeve 250 as shown in FIGS. 5A-5C. For Example, FIG. 5A illustrates a partial cutaway view of the fully assembled collecting tool 200, FIG. 5B illustrates a cross-sectional view along lines 5B in FIG. 5A, and FIG. 5C illustrates an enlarged view of the cutaway portion of FIG. 5A.

As assembled, the holder 210 may be sized, shaped, configured and/or adapted to fit within and/or be positioned or located inside the sleeve 250. The at least one uphole connection end 252 of the sleeve 250 may engage the retainer 230 of the holder 210. As described above, the one or more vanes 238 of the retainer 230 may maintain the holder 210 in place inside the exterior sleeve 250. In an embodiment, the holder 210 may engage a shoulder 256 on an inside surface of the sleeve 250 that may be nearest the at least one downhole connector end 254.

With reference to the cross-sectional view of FIG. 5B, the holder 210 may comprise the hollow core 212 for providing a central fluid pathway through the interior of the collecting tool 200. The holder 210 may further comprise the one or more fins 214 that may extend longitudinally along the holder 210. At least one recess 222 may be formed between and/or adjacent to each pair of fins 214. Each recess 222 may provide both at least one channel for fluid flow and at least one space for the collection of magnetic debris.

As shown in FIG. 5B, support members 242 may be provided. In an embodiment, the support members 242, such as struts, may be connected between adjacent fins 214 to provide stability to the fins 214. In some embodiments, the support members 242 may be arranged symmetrically while in other embodiments, such as the embodiment shown in FIG. 5B, the support members 242 may be arranged in a staggered manner.

Figure 8:
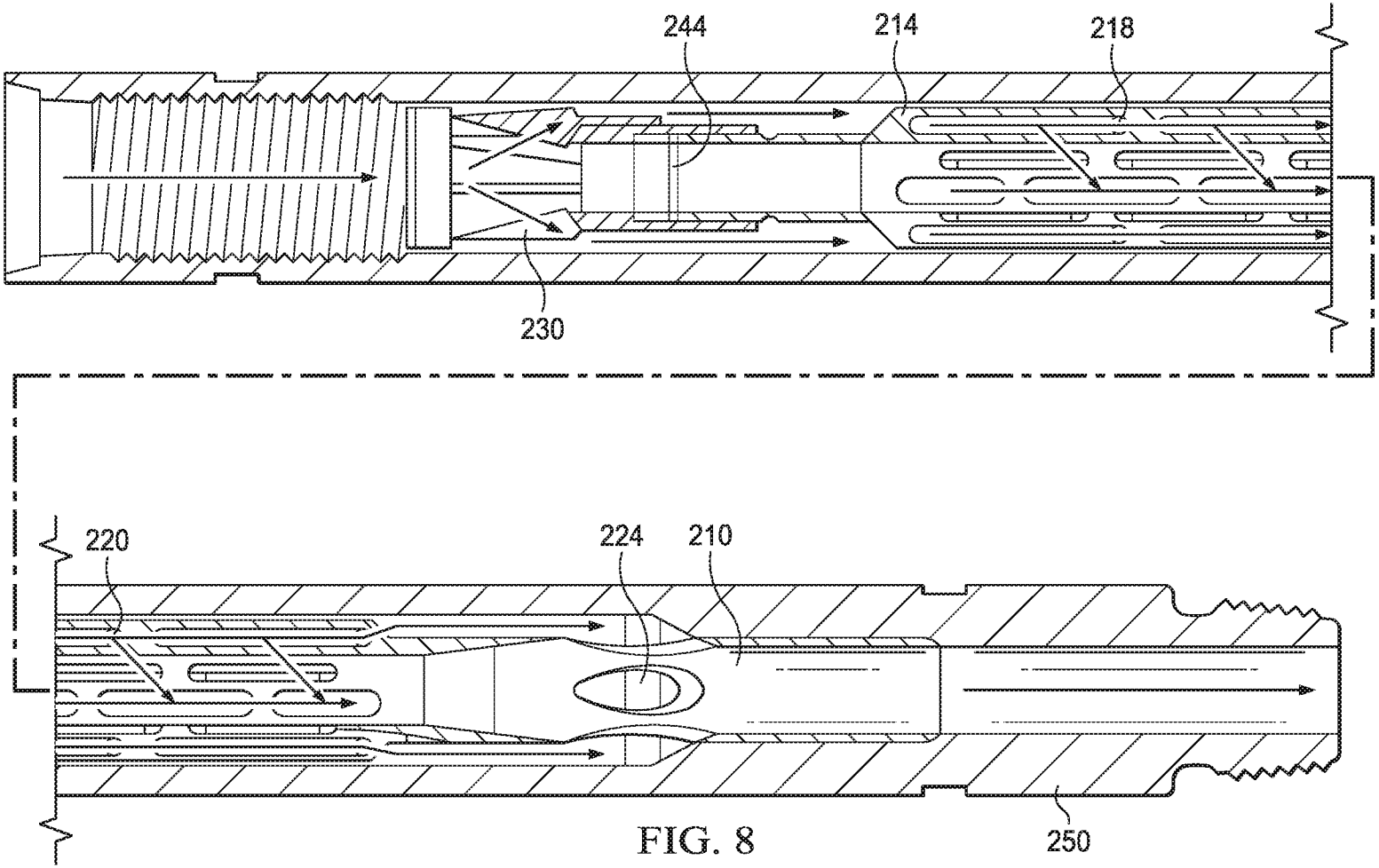
FIG. 8 is a side cross-sectional view of the assembled magnetic debris collecting tool, shown in FIG. 5A, according to embodiments of the present disclosure.

In embodiments, the retainer 230 may comprise at least one diverter 244 that may be configured to divert and/or separate a fluid flow path of drilling fluid 26 entering the collecting tool 200 into a plurality of fluid flow paths of drilling fluid 26 as shown in FIG. 8. As a result of being diverted and/or separated, the plurality of fluid flow paths of drilling fluid may flow or pass along exterior surfaces of the holder 210 and/or interior surfaces of the sleeve 250 for at least a portion of the length of the holder 210 as shown in FIG. 8. Before exiting the holder 210, the plurality of fluid flow paths of drilling fluid may be combined, joined or collected into an exiting fluid flow path of drilling fluid that may exit the holder 210 and/or the sleeve 250 or the collecting tool 200.

In an embodiment, the diverter 244 may be, for example, a rupture disc. The diverter 244 prevents the flow of fluid through the retainer 230 and diverts the flow to the fins 214 housing the magnets 218. For example, the flow of fluid entering the collecting tool 200 may be diverted or separated into at least one first fluid flow path of fluid and at least one second fluid flow path of fluid by the diverter 244. Such diverted or separated fluid flow path of fluid by the diverter 244 is shown by the arrows in FIG. 8. The magnetic debris is collected by the magnets 218 prior to the fluid flow entering the hollow core 212 of the interior magnet holder 210 through the flow receptacles 224.

In embodiments, the magnets 218 may become full or at least partially full of magnetic debris that fluid flow may be restricted through the collecting tool 200. As a result, the pressure may increase or be increased until the diverter 244 bursts, allowing fluid to flow through the retainer 230 and through the hollow core 212 of the interior magnet holder 210. The diverter 244 may allow for passage through the collecting tool 200 in an event there may be a need to pass another tool or device (e.g. for a fishing operation) through the collecting tool 200 without having to remove the collecting tool 200 from the wellbore 12 shown in FIG. 1.

Figure 11A:
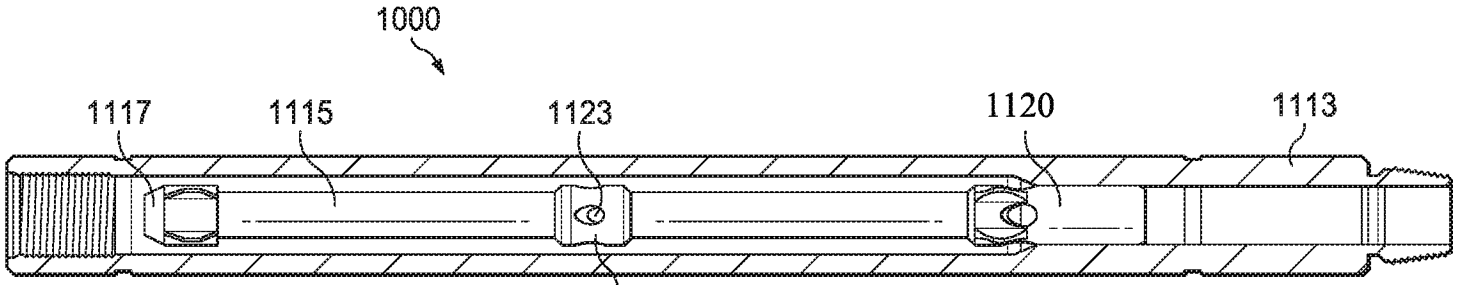
Figure 11B:
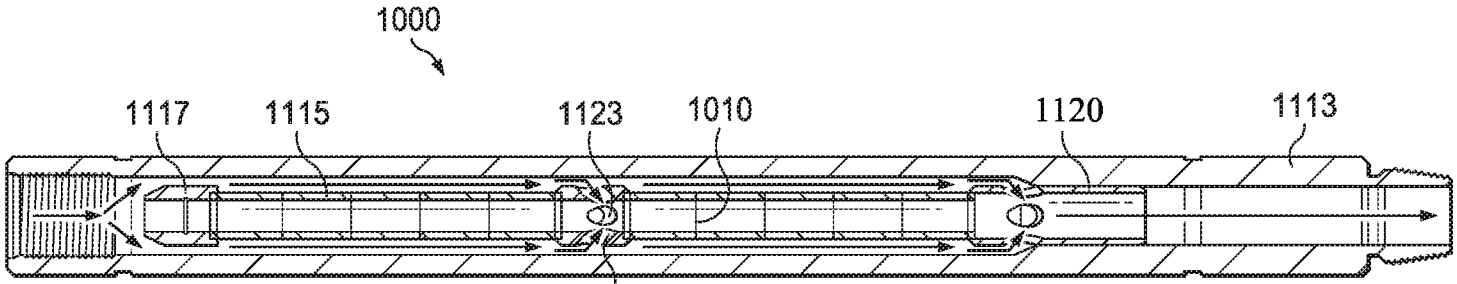
Figure 11C:
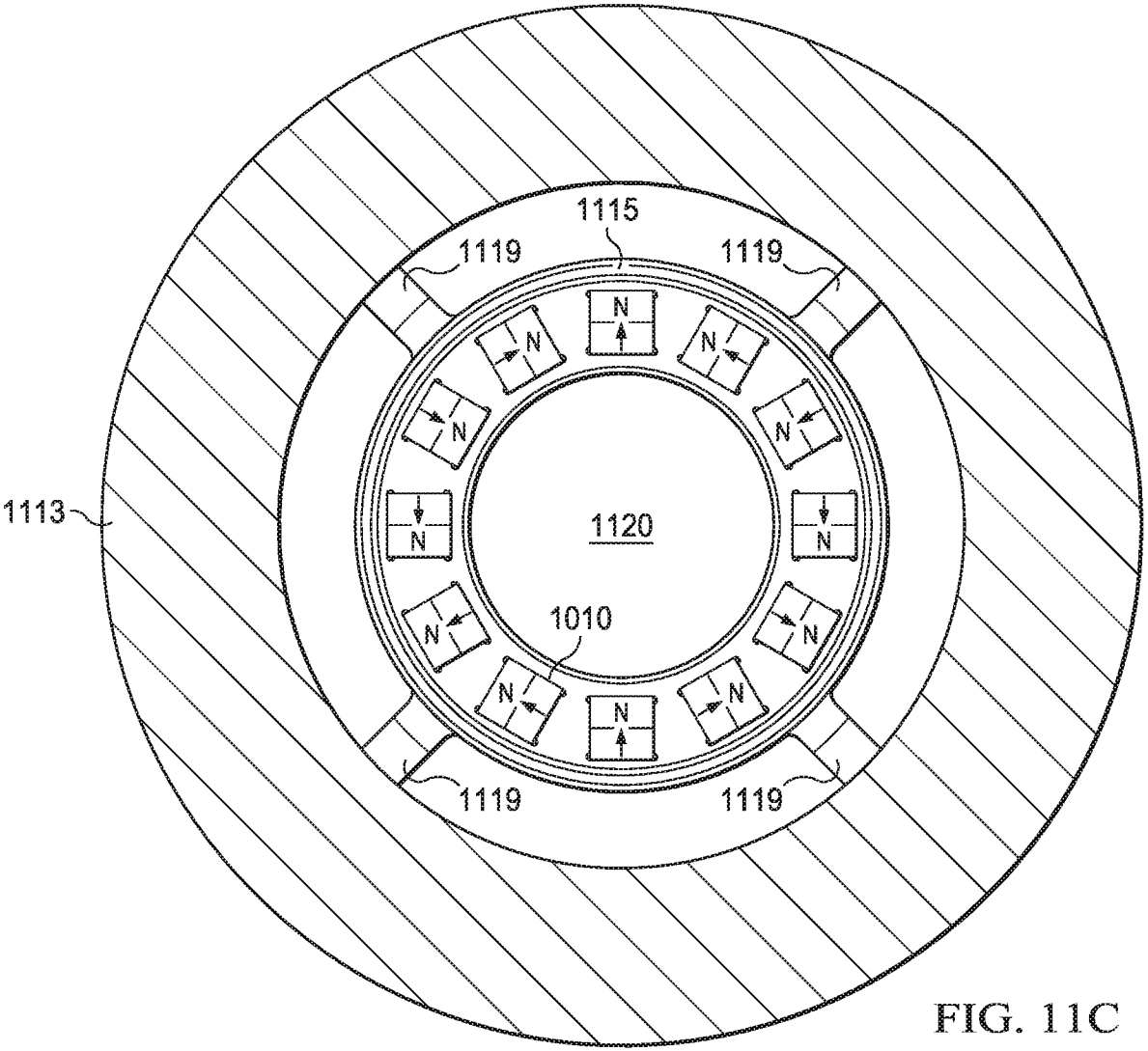

In embodiments, a magnetic debris collecting tool 1000 (hereinafter "the collecting tool 1000") having one or more magnets 1010 (hereinafter "the magnets 1010") arranged in a cylindrical Halbach array may be provided as shown in FIGS. 11A-11C. As a result of the cylindrical Halbach array, the collecting tool 1000 and the magnets 1010 may exhibit or provide a strong magnetic field oriented outside the cylindrical Halbach array. The interior magnet holder 1115 (hereinafter "the holder 1115") may comprise a hollow core 1020 configured or adapted for providing a central fluid pathway through the collecting tool 1000. The holder 1115 may be smaller than an exterior sleeve 1113 (hereinafter "the sleeve 1113") which may allow sufficient space therebetween for fluid flow, since magnetic debris is collectible by the strong magnetic field between the holder 1115 and the sleeve 1113.

Figure 11D:
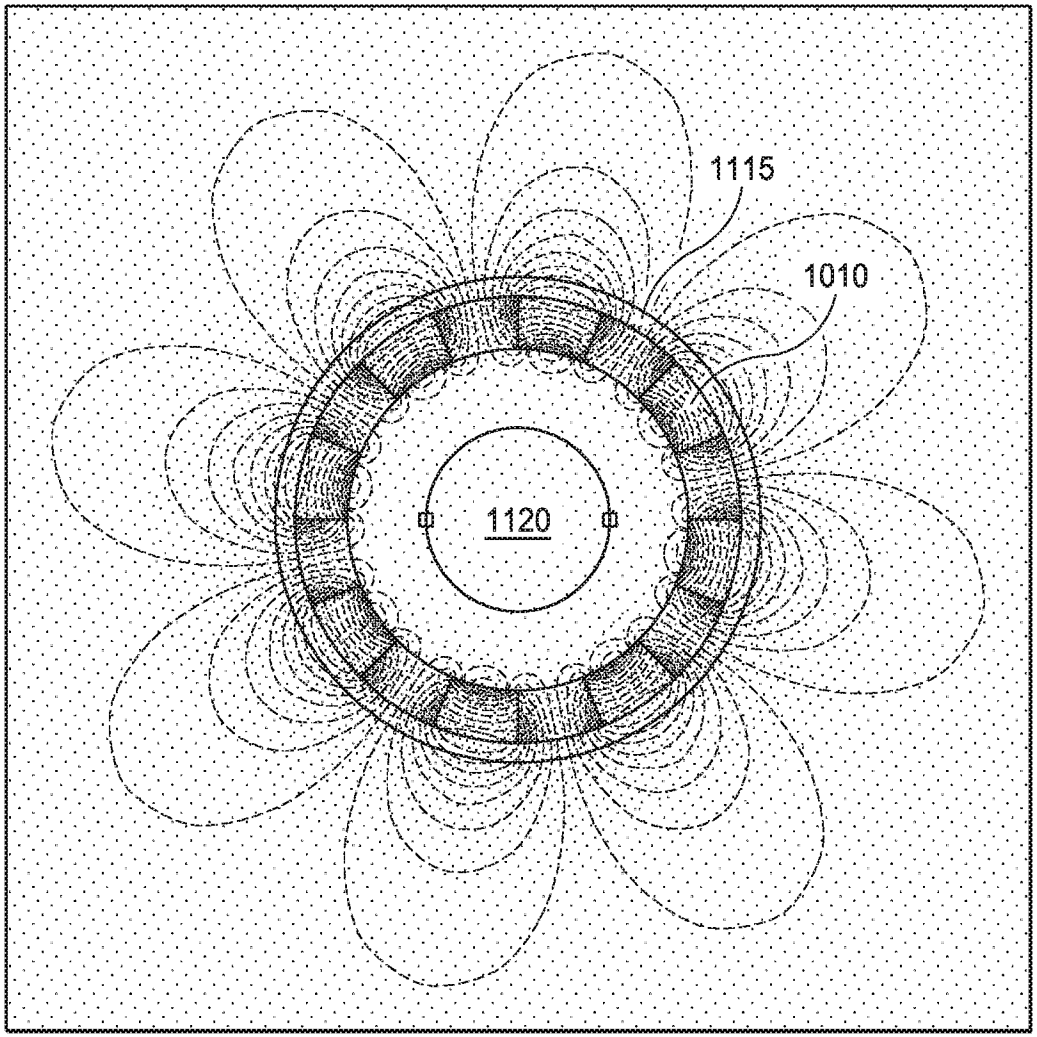

In embodiments, the magnets 1010 may be inserted, located and/or positioned inside one or more slots that may be circumnavigating a tubular wall, in the correct orientation to form the cylindrical Halbach array (shown in FIG. 11C). In an embodiment, the magnets 1010 may be, for example, one or more diametric bar magnets. In other embodiments, the magnets 1010 may be positioned, located and/or abutting against at least one flat or slotted outer surface of the holder 1115, and the sleeve 1113 may be added to affix the magnets 1010 in place (not shown) inside the collecting tool 1000. The strong resulting strength of the magnetic field of the cylindrical Halbach array may be outside the holder 1115, as shown in FIG. 11D.

The holder 1115 may have end caps 1117 with one or more vanes 1119 configured or adapted to hold or maintain the holder 1115 centrally, inside the sleeve 1113. In an embodiment, outer surfaces of the end caps 1117 may be flush and of a size to centralize the holder 1115 within the sleeve 1113. It should be understood that other centralizing means may be usable instead of vanes 1119.

In embodiments, a diverter 1118 may be provided, located and/or positioned to block fluid flow through the hollow core 1020 of the holder 1115. In an embodiment, the diverter 1118 may be, for example, a rupture disc. The diverter 1118 may prevent flow of fluid through the end cap 1117 and/or may divert the flow of fluid to the exterior of the interior magnet holder 1115 to allow the magnets 1010 to collect any magnetic debris present in the fluid flow prior to the fluid entering the hollow core 1020 of the holder 1115 through the flow receptacles 1123.

In an event wherein the magnets 1010 and/or surface area adjacent to the magnets 1010 may be become full, or at least partially full, of debris such that fluid flow is restricted through the collecting tool 1000, resulting pressure in the collecting tool 1000 may increase or may be increased until the diverter 1118 may burst, break or fail, which may allowing fluid to flow through the retainer end cap 1117 and through the hollow core 1020 of the holder 1115.

In some embodiments, at least one center coupling 1121 may couple, join or mate at least two or more holders 1115 together. In some embodiments, the center coupling 1112 may have one or more vanes (not shown) for centralizing the at least two or more holders 1115 within the sleeve 1113. In some embodiments, the center coupling 1112 may further comprise a flow receptacle 1123 configured or adapted for allowing fluid to flow to at least one inside surface of the holders 1115.

In embodiments, the magnets 103, the magnets 218 and/or the magnets 1010 (collectively known hereinafter as "magnets 103, 218, 1010") may be made of a suitable magnetic material, such as, for example, one or more rare earth magnetic materials, which may optionally be associated with flux carrying materials. Suitable magnetic materials for magnets 103, 218, 1010 may include neodymium iron boron, ceramic ferrite, samarium cobalt, or aluminum nickel cobalt, and the like. In some embodiments, the magnets 103, 218, 1010 may be comprised of samarium cobalt (SmCo) which is a strong permanent magnet made of an alloy of samarium and cobalt. In low temperature environments (up to 70° C./158° F.), the magnets 103, 218, 1010 may be made of, for example, neodymium or $Nd_2Fe_{14}B$. In an embodiment, the magnets 103, 218, 1010 may have a $BH_{max}$ of 50-53 MG.Oe (e.g., N52). Further, in embodiments, the magnets 103, 218, 1010 may be recessed and provided or located within one or more holes and/or grooves to protect the magnets 103, 218, 1010 from impact or damage that may occur during the drilling operation(s). In embodiments, the one or more holes and/or grooves housing or receiving the magnets 103, 218, 1010 may be formed in or provided on, for example, the holder 102 and/or the sleeve 104 of the collecting tool 100 shown in FIG. 1. Moreover, the magnets 103, 218, 1010 may provide one or more magnetic surface areas at, on, near and/or adjacent to the one or more holes and/or grooves of, for example, the collecting tool 100 that may house or receive the magnets 103, 218, 1010.

In embodiments, the magnets 103, 218, 1010 may be any shape, such as, for example, discs, bars or blocks, and/or rods. For example, the magnets 103, 218, 1010 of the present systems and methods may be any of the exemplary magnet shapes and types illustrated in FIGS. 2A-2N. In embodiments, the magnets 103, 218, 1010 may be oriented to provide or exhibit a maximum attraction or magnetic strength for catching, retain, collecting and/or holding magnetic debris within the collecting tool 100, the collecting tool 200 and the collecting tool 1000, respectively (collectively known hereinafter as "the collecting tools 100, 200, 1010").

For example, FIG. 2A illustrates that the magnets 103, 218, 1010, in one embodiment, may be block-shaped magnets having north and south poles on larger flat surfaces thereof and/or may be magnetized through its thickness thereof. In another embodiment, the magnets 103, 218, 1010 may be disc- or cylinder-shaped magnets having north and south poles on flat surfaces thereof and/or may be magnetized through its thickness thereof as shown in FIG. 2B. In yet another embodiment, the magnets 103, 218, 1010 may be block-shaped magnets having north and south poles on smaller flat surfaces thereof and/or may be magnetized through its length thereof as shown in FIG. 2C. In still yet another embodiment, the magnets 103, 218, 1010 may be block-shaped magnets having north and south poles on smaller flat surfaces thereof and/or may be magnetized through its length thereof as shown in FIG. 2C. In still yet another embodiment, the magnets 103, 218, 1010 may be disc- or cylinder-shaped magnets having north and south poles on side surfaces thereof and/or may be magnetized through its diameter thereof and/or may be diametrically magnetized as shown in FIG. 2D. In still yet another embodiment, the magnets 103, 218, 1010 may be spherical magnets having north and south poles on ends thereof and/or may be magnetized through its diameter thereof as shown in FIG. 2E. In still yet another embodiment, the magnets 103, 218, 1010 may be arc-shaped magnets having north and south poles on outside and inside faces thereof and/or may be magnetized through its diameter thereof as shown in FIG. 2F. In still other embodiments illustrated in FIGS. 2G-2N, the magnets 103, 218, 1010 may be circular- or arc-shaped magnets having different magnetizations, such as, for example, axial, diametral, pure radial, multipole radial, axial, radial, multipole axial, and multipole axial magnetization, respectively.

In an embodiment, the magnets 103, 218, 1010 may be bar magnets and/or may be aligned in the same orientation in, for example, each fin of the collecting tools 100, 200, 1010. Although this magnet alignment may result in a high level magnetic field in, for example, the recess of collecting tools 100, 200, 1000. In other embodiments, other magnet shapes and arrangements may be possible and/or may remain within the purview of the embodiments of the present disclosure.

Figure 6:
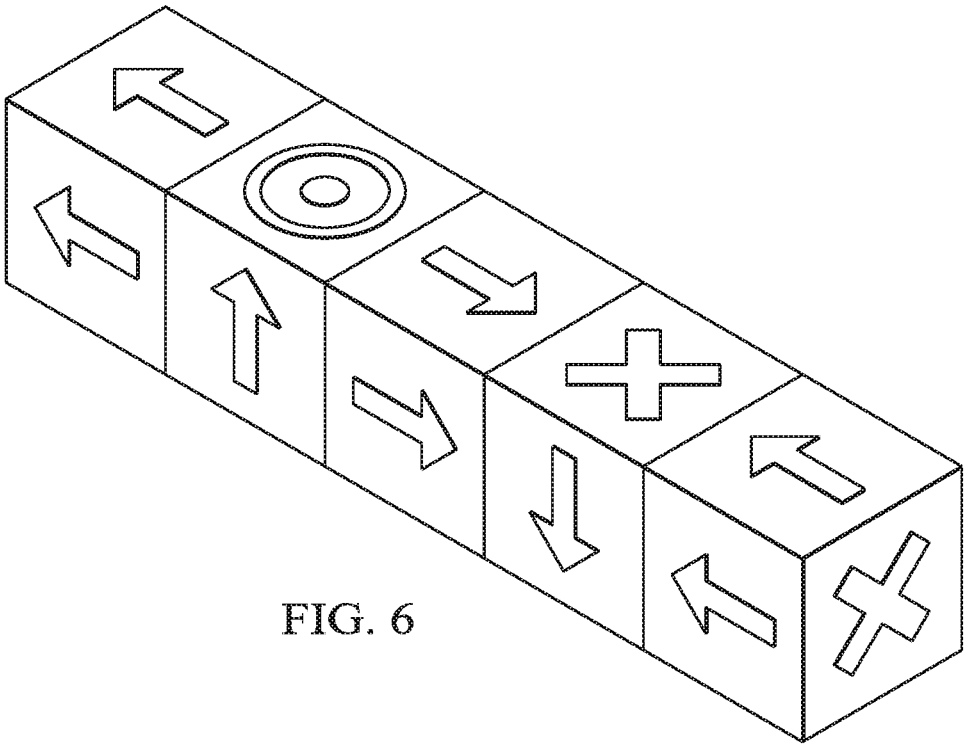
FIG. 6 is a perspective view of orientations of magnetic field pieces of a non-cylindrical Halbach Array usable with a magnetic debris collecting tool in embodiments of the present disclosure.
Figure 7:
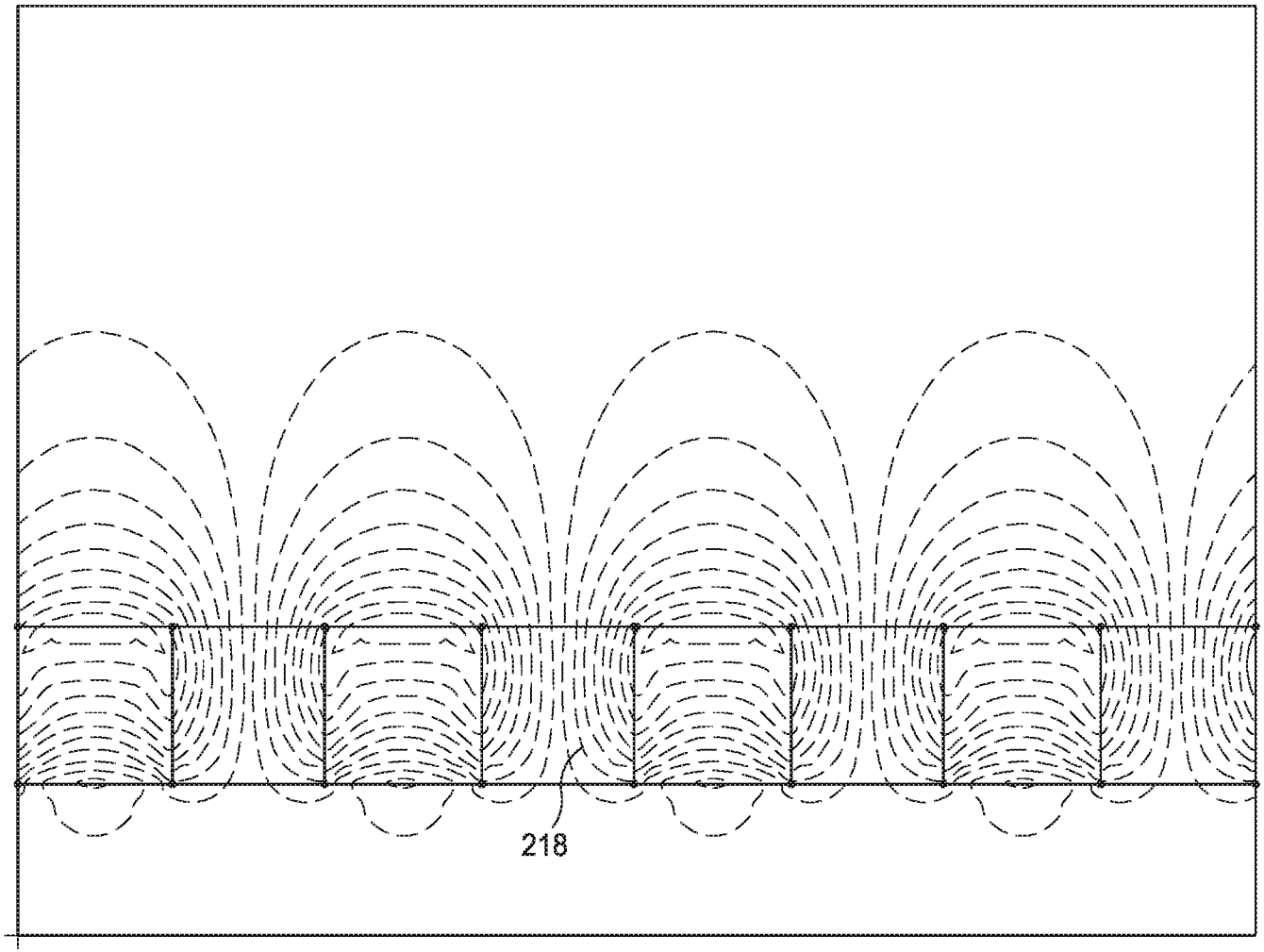
FIG. 7 illustrates a flux diagram of magnetic field lines around the Halbach Array, shown in FIG. 6, according to embodiments of the present disclosure.

For example, another possible arrangement of the magnets 103, 218, 1010 may be a linear Halbach array that may be preassembled, provided, located, positioned and/or inserted into the slots provided in collecting tools 100, 200, 1000, respectively. As a result, one or more strong magnetic fields may face the recesses in the collecting tools, 100, 200, 1000. In this embodiment, it may be preferred to place a pair of arrays back to back and/or may be separated by a small portion or layer of the fin (e.g., use back to back depressions). A Halbach array may be a special arrangement of permanent magnets that augments the magnetic field on one side of the array while cancelling the field to near zero on the other side. This is achieved by having a spatially rotating pattern of magnetization, as shown in FIG. 6. The rotating pattern of the magnets 103, 218, 1010 may be continued and/or may have the same effect, roughly similar to many horseshoe magnets placed adjacent to each other, with similar poles touching. FIG. 7 illustrates the magnetic field lines generated by the magnets 103, 218, 1010 which may be arranged, located, positioned and/or provided in a Halbach array.

Figure 9A:
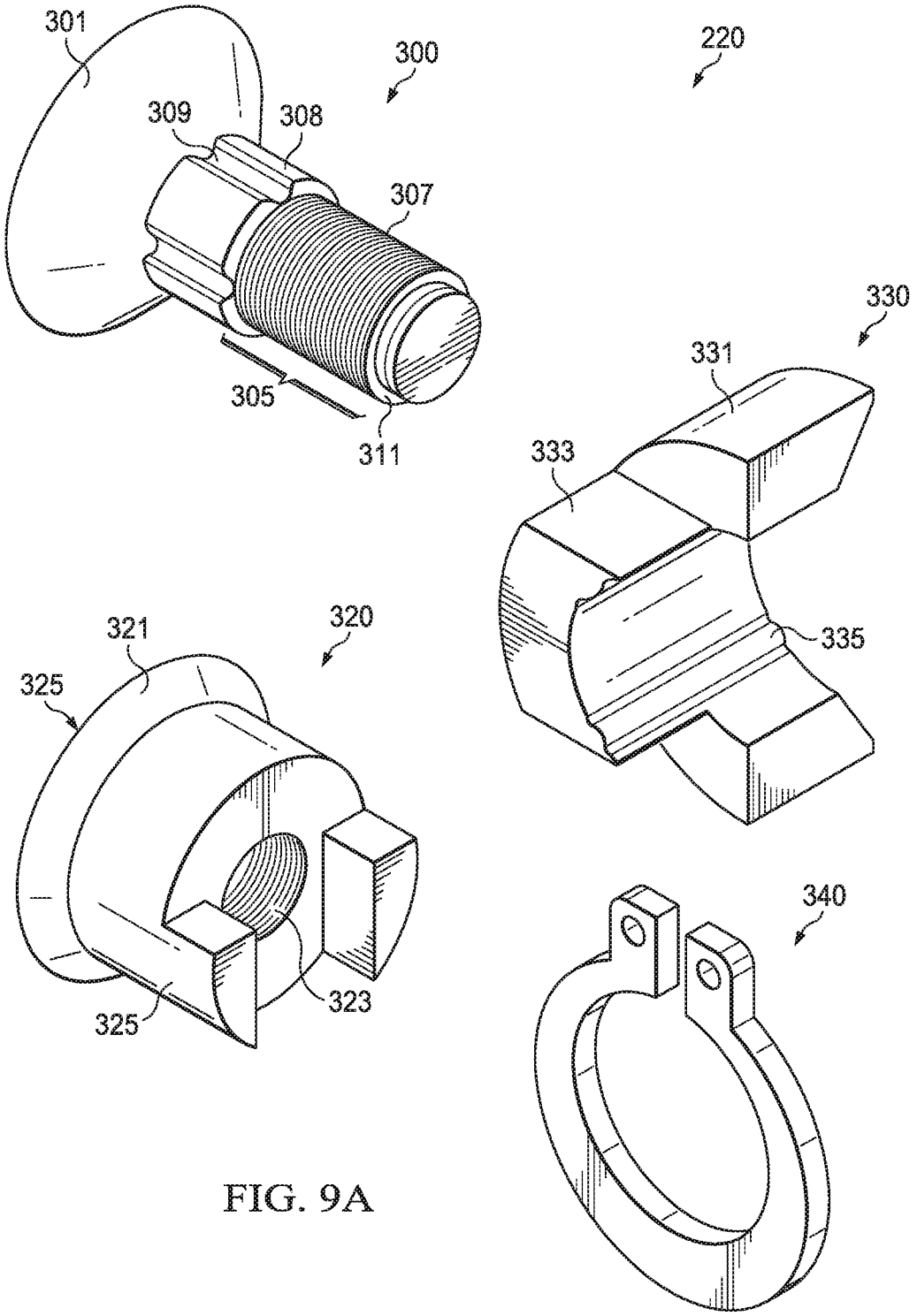

In embodiments, the fastener assembly 220 may affix the magnets 103, 218, 1010 to, for example, the fins 214 of collecting tool 200 as shown in FIGS. 9A-9F. In an embodiment, FIG. 9A shows perspective views of four components of the fastener assembly 220, which may include at least one rivet or bolt 300, at least one retainer or at least one nut 320, at least one locking member 330 and/or at least one ring clip 340.

In an embodiment, the at least one bolt 300 may have a head 301 and a stem 305. A threaded portion 307 of the stem 305 may have a bottom edge with a groove 311 to fit the ring clip 340. A locking portion 308 of the stem 305 closer to the head 301 may have one or more recesses 309 arranged around its outer circumference. The recesses 309 may be sized, shaped, configured and/or adapted to fit corresponding protrusions or detents 335 on the inner surface of the locking member 330. The top of the bolt 300 may have, for example, a hexa-wrench socket 303 (visible in FIG. 9E), but other socket shapes may be used in embodiments of the present disclosure.

In some embodiments, the locking member 330 may be C-shaped, fitting to one side of the at least one bolt 300 and above the at least one nut 320. An upper portion 331 of the locking member 330 may circumnavigate about, for example, a half of the bolt 300, but a smaller section 333 may circumnavigate about a quarter of the bolt 300 and/or may provide a surface against which the at least one locking member 330 may lockingly fit on the at least one bolt 300. The at least one locking member 330 may be made of, for example, nylon or other slightly flexible material, while the at least one bolt 300 and/or the at least one nut 320 may be made of a metal, such as, for example, a steel. The nylon may allow a small amount of flex, such that the bolt 300 may be turned until detents 305 may seat in the recesses 309 and/or may be positioned, located and/or provided in the recesses 309. As a result, the at least one bolt 300 may be located, positioned or locked in place and/or may prevent the at least one bolt from backing out or moving to an unlocked position.

In embodiments, the at least one nut 320 may have at least one collar 321 at or along its base, which may fit flush against the surface of the at least one fin 214. At least one threaded hole 323 may be provided for receiving the threaded stem 305. The top of the nut 320 may have at least one circular depression 325 for fitting the ring clip 340 such that the ring clip may also be flush. Protruding from the bottom of the at least one nut 320 may be one or more projections 325, which may lock a mated projection 333 from the at least one locking member 330. In an embodiment, the projections 325 may bracket the locking member 330, but these components may be reversed or at least partially reversible.

In embodiments, the at least one ring clip 340 may be partially split to easy installation and removal of the at least one ring clip 340. Turning the bolt 300 may allow the one or more detents 305 to escape or move from the recesses 309, and the fastener assembly 220 may be removed or at least partially removable. Thus, the fastener assembly 220 may be easily assembled and/or disassembled, yet the bolt 300 may resist backing out in the high vibration environment downhole. Further, the ring clip 340 and/or the locking member 330 may provide resistance to backout, which may make the fastener assembly 220 much more robust and/or resistant to accidental or even intentional tampering. However, in other embodiments, the at least one locking member 330 may be omitted, and the fastener assembly 220 may comprise the at least one bolt 300, the at least one nut 320, and/or the at least one ring clip 340.

Figure 9B:
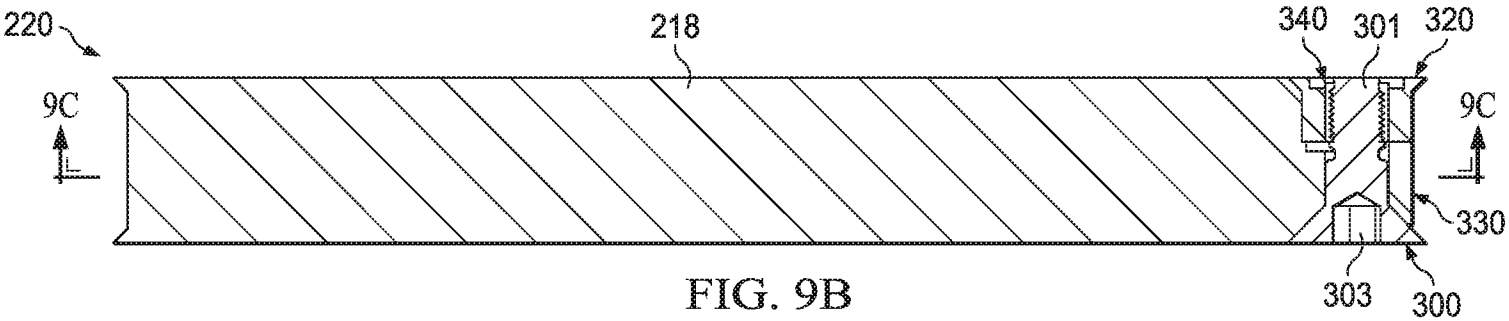
Figure 9C:
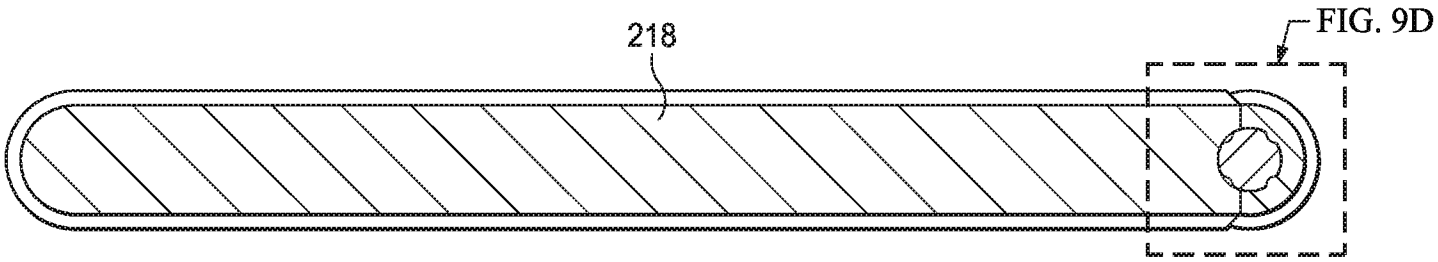
Figure 9D:
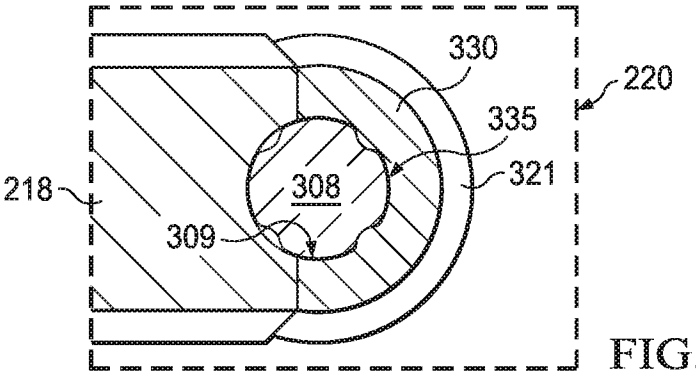
Figure 9E:
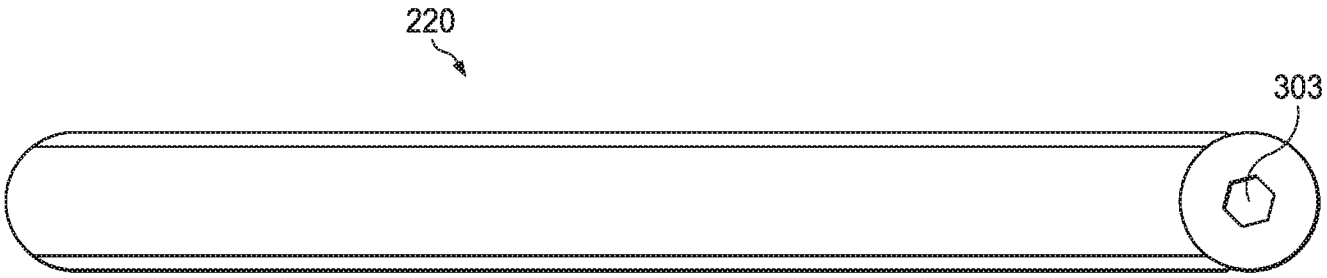
Figure 9F:
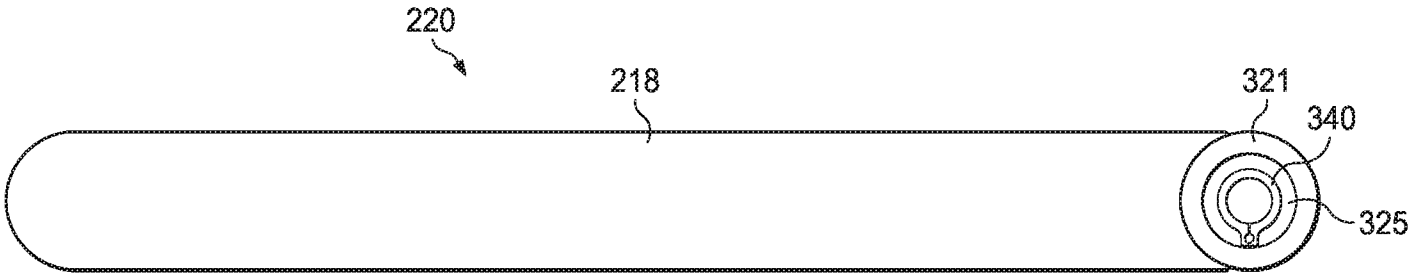

These same components are shown assembled in vertical cross section in FIG. 9B, in horizontal cross section in FIG. 9C, enlarged in FIG. 9D, and from bottom and top views in FIGS. 9E and 9F, respectively.

Figure 10:
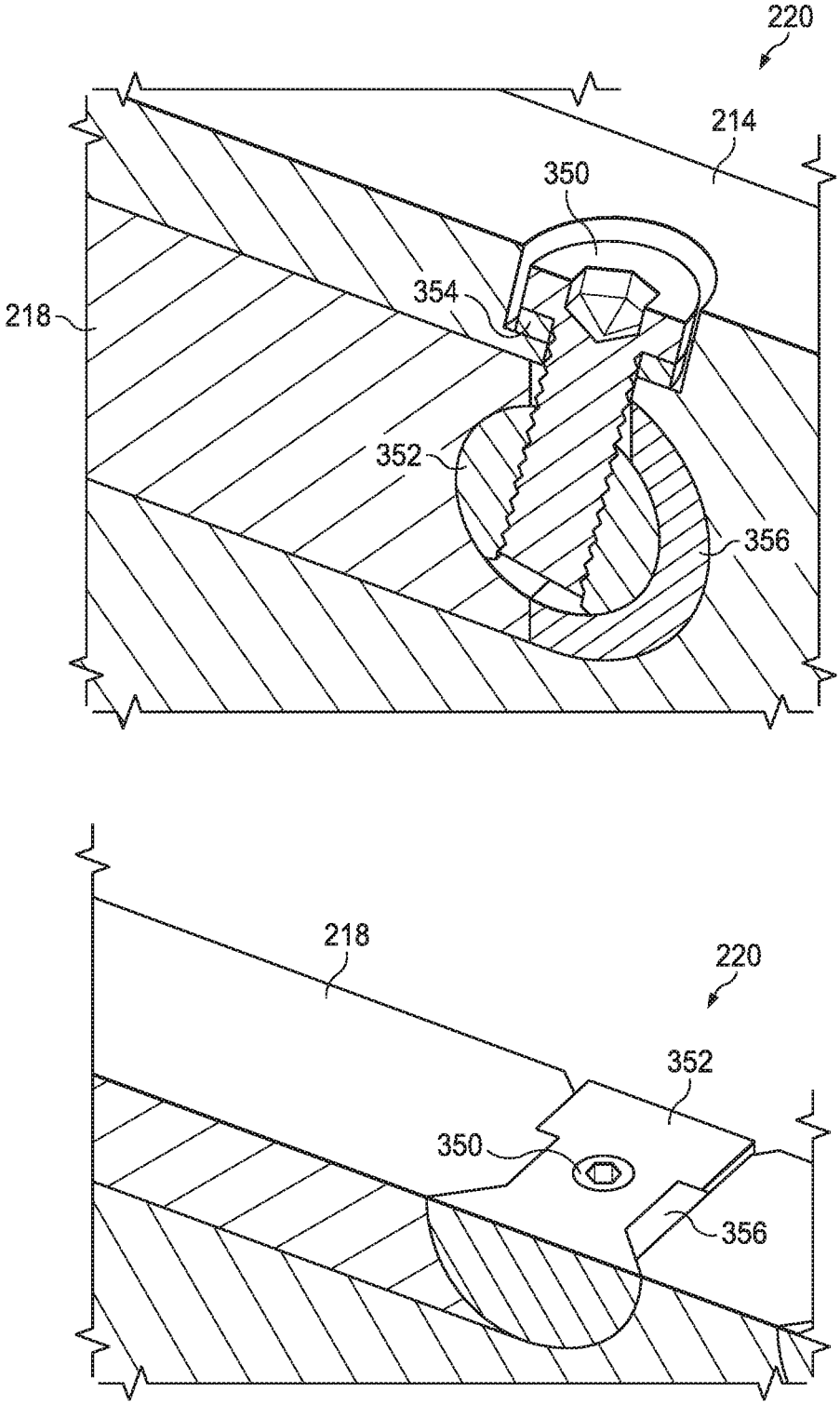
FIG. 10 illustrates cross-sectional views of a fastener assembly according to embodiments of the present disclosure.

In embodiments, the fastener assembly 220 may comprise a nut and bolt assembly as shown in FIG. 10. The nut and bolt assembly of the fastener assembly 220 may comprise at least one bolt 350, at least one nut 352, at least one washer 354 and/or at least one small spacer 356 which may be designed to fill remaining space within, for example, the slots 216 in the fins 214 of the holder 210 of the collecting tool 200. In embodiments, the magnets 103, 218, 1010 may be affixed to the collecting tools 100, 200, 1000 by other means, such as, for example, a bolt or screw through the magnet (not shown in the drawings).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening parts, a nail and a screw are equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system for retaining magnetic debris from drilling fluid in a wellbore, the system comprising:

an interior holder having a length defined between a first end of the interior holder and an opposite second end of the interior holder;

an exterior sleeve having a length defined between a first end of the exterior sleeve and an opposite second end of the exterior sleeve and an interior space configured to receive the interior holder, wherein the first end of the exterior sleeve is connectible to a first portion of drill string such that, when the exterior sleeve is connected to the first portion of drill string, the interior space of the exterior sleeve is in fluid communication with a longitudinal bore of the drill string;

at least one longitudinal passage provided between the interior holder and the exterior sleeve and extending from the first end of the exterior sleeve to the second end of the exterior sleeve while the interior holder is located within the exterior sleeve such that a fluid flow path of drilling fluid through the longitudinal bore of the drill string is passable from the first portion of drill string through the at least one longitudinal passage when the exterior sleeve is connected to the first portion of drill string; and a plurality of magnetic material provided on or in the interior holder, wherein the plurality of magnetic material extends at least one selected from along at least a portion of the length of the interior holder and around at least a portion of a circumference of the interior holder, wherein at least one magnetic field, provided by the plurality of magnetic material, extends into or across the at least one longitudinal passage while the interior holder is located within the exterior sleeve such that magnetic debris is removable by the at one magnetic field from the fluid flow path of drilling fluid passing through the at least one longitudinal passage when the exterior sleeve is connected to the first portion of drill string.

2. The system according to claim 1, wherein the interior holder comprises a hollow core extending from the first end of the interior holder to the second end of the interior holder.

3. The system according to claim 2, further comprising:

at least one slot formed in the interior holder such that fluid is flowable from at least one exterior surface of the interior holder through the at least one slot to the hollow core of the interior holder.

4. The system according to claim 1, further comprising:

at least two fins provided on at least one exterior surface of the interior holder; and at least one recess positioned between the at least two fins.

5. The system according to claim 4, wherein the plurality of magnetic material comprises magnets connected to at least one fin of the at least two fins provided on the at least one exterior surface of the interior holder.

6. The system according to claim 4, further comprising:

a plurality of slots formed in at least one fin of the at least two fins provided on the exterior surface of the interior holder, wherein the plurality of magnetic material is located within the plurality of slots.

7. The system according to claim 1, wherein the plurality of magnetic material is located within, and enclosed inside, the interior holder.

8. The system according to claim 7, wherein the plurality of magnetic material comprises magnets located around the circumference of the interior holder.

9. The system according to claim 8, wherein the magnets of arranged in a circular Halbach array around the circumference of the interior holder.

10. The system according to claim 2, wherein the plurality of magnetic material comprises magnets located within the interior holder between the exterior surface of the inner holder and the hollow core of the inner holder.

11. The system according to claim 10, wherein at least a first magnet and a second magnet of the magnets are arranged around the circumference of the inner holder, a first magnetic field of the first magnet is orientated differently than a second magnetic field of the second magnet, and the first magnet is located adjacent to the second magnet.

12. A method comprising:

providing an exterior sleeve having a length defined between a first end of the exterior sleeve and an opposite second end of the exterior sleeve and an interior space defined by a wall of the exterior sleeve extending between the first and second ends of the exterior sleeve, wherein the first end of the exterior sleeve is connectible to a first portion of drill string;

positioning a plurality of magnets on or adjacent to an exterior surface of an interior holder that has a length defined between a first end of the interior holder and an opposite second end of the interior holder; and positioning the interior holder in the interior space of the exterior sleeve such that at least one fluid flow path is provided between the exterior surface of the interior holder and the exterior sleeve or extends from the first end of the exterior sleeve to the second end of the exterior sleeve and at least one magnetic field of the plurality of magnets extends into or across the fluid flow path for retaining magnetic debris from fluid passing or moving along the at least one fluid flow path.

13. The method according to claim 12, wherein the plurality of magnets is housed within the interior holder extending at least one selected from along at least a portion of the length of the interior holder and around a circumference of the interior holder.

14. The method according to claim 12, further comprising:

orientating two adjacent magnets of the plurality of magnets differently with respect to each other such that the two adjacent magnets provide two different magnetic fields that extend outwardly with respect to the exterior surface of the interior holder.

15. The method according to claim 12, further comprising:

extending at least one fin or vane outwardly with respect to the exterior surface of the interior holder along at least a portion of the length of the interior holder; and positioning the plurality of magnets adjacent to the at least one fin or vane.

16. The method according to claim 12, further comprising:

connecting the first end of the exterior sleeve to the first portion of drill string such that a longitudinal bore of the first portion of drill string is in fluid communication with the at least one fluid flow path.

17. The method according to claim 12, further comprising:

flowing drilling fluid along the at least one fluid flow path.

18. The method according to claim 12, further comprising at least one selected from:

removing magnetic debris from drilling fluid flowing along the at least one fluid flow path with the at least one magnetic field from the plurality of magnets; and collecting magnetic debris from the drilling fluid flowing along the at least one fluid flow path at one or more magnetic surface areas provided by the plurality of magnets.

19. A magnetic debris collecting tool comprising:

a sleeve having a length defined between a first end of the sleeve and an opposite second end of the sleeve, wherein the first end of the sleeve is connectible to at least one portion of drill string;

at least one fluid flow path extending through the sleeve from the first end of the sleeve to the second end of the sleeve such that the at least one fluid flow path is in fluid communication with the at least one portion of drill string when the sleeve is connected to the at least one portion of drill string;

one or more magnetic surface areas provided inside the sleeve and adjacent with respect to at least one portion of the at least one fluid flow path extending though the sleeve such that magnetic debris in fluid flowing or passing along the at least one fluid flow path is collectible at or on the one or more magnetic surface areas when the sleeve is connected to the at least one portion of drill string; and an interior magnetic holder positioned inside the sleeve, wherein the at least one portion of the at least one fluid flow path contacts an exterior surface of at least one portion of the interior magnetic holder comprising the one or more magnetic surface areas.

20. The magnetic debris collecting tool according to claim 19, the interior magnetic holder having a hollow core.

* * * * *